US005140968A

United States Patent [19]

Doan

[11] Patent Number: 5,140,968

[45] Date of Patent: Aug. 25, 1992

[54] CLOSED LOOP BREATHER SYSTEM FOR ENGINE CRANKCASE

[75] Inventor: Thien D. Doan, Aurora, Ill.

[73] Assignee: Navistar International Transportation Corp., Chicago, Ill.

[21] Appl. No.: 836,633

[22] Filed: Feb. 14, 1992

[51] Int. Cl.[5] ..... F02M 25/06

[52] U.S. Cl. ..... 123/572; 123/573

[58] Field of Search ..... 123/572, 573, 574, 41.86

[56] References Cited

U.S. PATENT DOCUMENTS

| | | | |
|---|---|---|---|
| 1,411,343 | 4/1922 | Gore | 123/572 |
| 3,116,727 | 1/1964 | Dietrich | 123/572 |
| 3,545,416 | 12/1970 | Von Brimer | 123/572 |
| 4,279,236 | 7/1981 | Dallman | 123/572 |
| 4,753,214 | 6/1988 | Langlois et al. | 123/572 |
| 4,862,860 | 9/1989 | Shinohara | 123/572 |
| 4,962,745 | 10/1990 | Ohno et al. | 123/572 |
| 5,080,082 | 1/1992 | Mueller et al. | 123/572 |

*Primary Examiner*—Tony M. Argenbright
*Assistant Examiner*—M. Macy
*Attorney, Agent, or Firm*—Dennis K. Sullivan

[57] ABSTRACT

A closed loop engine crankcase breather system is provided with a breather tube engaged between a rocker arm housing of the engine and an intake air tube of the engine downstream of the air cleaner therefor. The end of the breather tube within the intake air tube is curved so that the opening thereof faces directly into the stream of air flowing through the intake air tube to thereby reduce the vacuum within the crankcase by the velocity head of the intake air stream and thus maintain a smaller pressure differential between the interior cavity of the engine and the atmosphere.

5 Claims, 1 Drawing Sheet

CLOSED LOOP BREATHER SYSTEM FOR ENGINE CRANKCASE

BACKGROUND OF THE INVENTION

The present invention relates to a closed loop breather system for a crankcase of an internal combustion engine of the type which recirculates piston blowby in the crankcase to the intake air line of an engine to eliminate the discharge of oil mist into the environment and, more particularly, to a breather system which limits the pressure differential between the engine crankcase and atmosphere.

THE PRIOR ART

Ideally, the pressure within an internal combustion engine crankcase should be maintained at a level equal to or slightly less than atmospheric pressure to prevent external oil leakage through the various gasketed joints, such as that between the valve cover and the cylinder head. Because of combustion leakage past the piston rings or blowby, the crankcase pressure will inherently rise, promoting leakage of oil from the crankcase. Originally, the crankcase pressure was vented to the atmosphere through a breather to solve this problem.

Later, environmental considerations dictated that the fumes in the crankcase be vented back to the combustion chamber rather than being released to the atmosphere. Accordingly, the crankcase was scavenged by being connected to the engine air intake thereby resulting in a vacuum in the crankcase with a depression valve being used to prevent the negative pressure in the engine cavity from exceeding a predetermined amount. If the vacuum in the crankcase can be maintained less than about 10 inches water, oil leakage is significantly reduced, if not altogether eliminated. Unfortunately, because there is an oil mist passing through the depression valve, the valve can become stuck. If the valve is stuck open, the negative pressure in the crankcase can increase to several inches water above the 10 inch limit thereby sucking the gaskets inwardly. If a portion of the gasket is broken as a result, then, when the engine is stopped, leakage will occur causing an unsightly appearance to the engine.

SUMMARY OF THE INVENTION

A primary object of the closed loop engine crankcase breather system of the present invention is to provide a cost effective structure which will maintain a pressure differential between the engine crankcase and atmosphere within predetermined limits while venting blowby in the crankcase to the intake air line of the engine.

A further object of the closed loop engine crankcase breather system of the invention is to eliminate the depression valve presently used and there any problems arising from a stuck valve.

A further object of the invention is to provide a closed loop crankcase breather system which maintains the vacuum within the crankcase at a level less than 10 inches water.

These objects as well as others are specifically met in a closed loop engine crankcase breather system wherein a breather tube is connected between a rocker arm housing and the intake air passage to the turbocharger compressor of a turbocharged engine. Within the intake air passage, the breather tube is provided with a pitot tube having an opening facing into the direction of flow of air in the intake passage. Since the pitot tube produces a positive pressure head as a result of the velocity of the intake air flow, the vacuum or negative static pressure in the crankcase is reduced and may be maintained at an acceptable value throughout the engine speed range.

BRIEF DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENT

Figure 1:
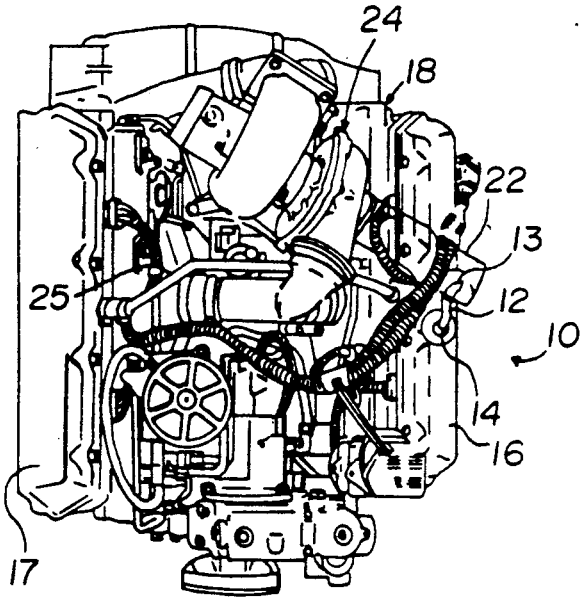
FIG. 1 is a top view of a turbocharged engine and shows a closed loop crankcase breather system of the present invention engaged to and between a valve housing of the engine and the compressor air inlet line of a turbocharger.

Referring now to the drawings in greater detail, there is illustrated therein a closed loop engine crankcase breather system of the present invention generally identified by the reference numeral 10 mounted on an internal combustion engine 18, preferably a diesel engine.

The breather system 10 comprises a breather tube 12 having an inlet end 14 in fluid communication with the interior of a valve housing 16 of engine 18 and an outlet end 20 (FIG. 2) in fluid communication with a pitot tube fitting 13 mounted on an intake air line 22 of the engine 18 and extending therewithin. When the engine 18 is turbocharged as shown, pitot tube fitting 13 is located in the compressor air inlet line to the turbocharger 24. In a naturally aspirated engine, the pitot tube would be located in the intake air passage from the air cleaner.

In a V-8 engine, such as shown in the drawings, a crossover tube 25 interconnects the valve housing 16 with the valve housing 17 of other bank of the engine to equalize the pressure throughout the engine. It will be understood that the rocker arm housing 16 defines a portion of a closed interior cavity of the engine and that there is a continuous internal air path existing within and between the crankcase and the rocker arm housing 16. Thus, venting of the valve housing 16 will necessarily vent the interior of the crankcase as well as valve housing 17.

Figure 2:
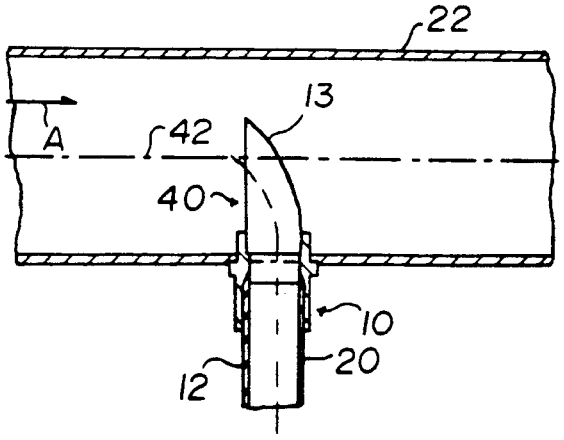
FIG. 2 is an enlarged cross sectional view through a portion the intake air tube of the engine of FIG. 1 showing the orientation of the breather tubing therewithin.

As further illustrated in FIG. 2, an outlet opening 40 of the pitot tube 13 within the intake air tube 22 is oriented to face directly into the stream of air flowing therethrough, the tube 13 appearing in the form of an air scoop. Preferably, the opening 40 is located as close as possible to a central axis 42 of the intake air tube 22. The function of the pitot tube 13 positioned in this manner is based on fluid dynamic principles, with the pressure at the tube opening 40 being equal to stagnation pressure, i.e. the negative static pressure in the tube 22 plus the positive velocity head or pressure of the air stream. Thus, the vacuum or negative pressure within the pitot tube, the breather tube 12, the valve housing 16, and the crankcase will be less negative than in the intake air tube 22. Since the pressure in the valve housing 16 must always be higher than the pressure in the intake tube 22 when the engine is operating, venting of blowby from the crankcase through the tube 12 into the intake air tube 22 will occur continuously.

Figure 3:
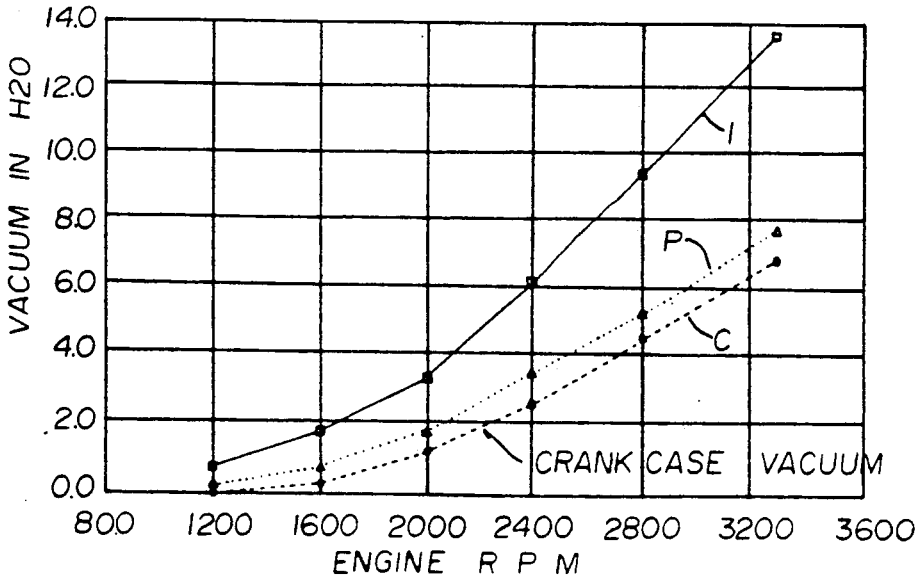
FIG. 3 is a graph comparing the pressures within the intake air tube and within the crankcase through the engine speed range.

It will be understood that the negative pressure or vacuum within the intake air line 22 inherently increases as engine rpm increases, the engine 18 requiring more air at higher rpm levels. However, the intake air velocity similarly increases. Accordingly, as shown in the graph of FIG. 3, the negative pressure or vacuum within the crankcase also will increase at higher engine rpm levels, but will remain within the desired range.

Optimum use of the breather assembly 10 of the invention to raise the negative pressure which would otherwise be present in the breather tube 12 is achieved by directing the opening 40 of the pitot tube 13 with intake tube 22 to face into the incoming air stream defined by arrow A in FIG. 2. This is accomplished by creating a curve within the end 20 of the pitot tube 13 which orients the opening 40 into a plane radial to the intake tube 22 and well away from the wall thereof.

Directing the opening 40 in the pitot tube 13 into the air stream in the tube 22 is critical. If the opening 40 were to lie in a plane transverse to or opposite the direction of air flow, highly negative pressures would develop within the crankcase, the air flow causing a vacuum effect across the opening 40. With the opening 40 being oriented to face into the oncoming stream of air A as shown, a crankcase vacuum less than 10 inches water can be maintained throughout the operating range of rpm for the engine 18, as shown in the graph of FIG. 3 which compares the vacuum level I in the intake tube with the vacuum level P at the pitot opening and with the vacuum level C in the crankcase through the speed range of an engine.

However, the orientation of the opening 40 of the pitot tube 13 is not the only controlling parameter in the breather system 10. The diameter of the pitot tube 13 must be found through empirical testing, depending on the blow-by characteristics of the engine, the desired crankcase pressure condition, and the amount of oil blow-by which is acceptable within the intake air.

In this respect, if the diameter of the pitot tube 13 is too small, its effect on crankcase pressure will be insignificant. On the other hand, if the diameter is too large, significant amounts of oil mist will be ingested by the engine resulting in deleterious effects on performance.

As described above, the closed loop crankcase breather system of the present invention has a number of advantages, some of which have been described above and others of which are inherent in the invention. Also, it will be apparent to those of ordinary skill in the art that alterations and modifications to the closed loop crankcase breather system can be made without departing from the teachings herein. Accordingly, the scope of the invention is only to be limited as necessitated by the accompanying claims.

What is claimed is:

1. A crankcase breather system for an internal combustion engine . comprising tube means establishing fluid communication between an interior cavity of the engine and an engine intake air passage, said tube means extending within said engine air intake passage and having an opening into said tube means disposed to face into the incoming air stream within said intake air passage.

2. The breather system of claim 1 wherein said opening of the tube means is centrally disposed within the air intake passage and the outlet end of the tube within said passage is curved to cause said opening to be disposed perpendicular to said incoming air stream.

3. The breather system of claim 2 wherein an end of said tube means opposite said opening engages within a rocker arm housing of the engine.

4. In a diesel engine having an intake air line and a closed interior cavity, a breather comprising a tube engaged to and between said interior cavity and said intake air line and having an outlet thereof centrally disposed within said intake air line and facing into an incoming air stream entering the intake air line.

5. In combination with a turbocharged engine having a closed interior cavity, a turbocharger having an air inlet, and an air intake tube disposed upstream of said turbocharger air inlet, a breather system for maintaining pressure within said cavity near atmospheric pressure without venting oil mist therefrom to the ambient environment comprising a tube of predetermined diameter having an inlet end disposed for fluid communication with said cavity of the engine and having an outlet end thereof entering said intake air tube upstream of the turbocharger, said tube outlet end having an outlet within said intake tube, said outlet facing in the upstream direction within the intake air tube.

* * * * *